United States Patent [19]

Ehrlinger et al.

[11] Patent Number: 4,550,296

[45] Date of Patent: Oct. 29, 1985

[54] WAVEGUIDE-MICROSTRIP TRANSITION ARRANGEMENT

[75] Inventors: Wolfgang Ehrlinger, Grossbottwar; Gerhard Hirsch; Michael Alberty, both of Backnang, all of Fed. Rep. of Germany

[73] Assignee: ANT Nachrichtentechnik GmbH, Backnang, Fed. Rep. of Germany

[21] Appl. No.: 493,824

[22] Filed: May 12, 1983

[30] Foreign Application Priority Data

May 13, 1982 [DE] Fed. Rep. of Germany ..... 3217945

[51] Int. Cl.[4] ..... H01P 5/107

[52] U.S. Cl. ..... 333/26; 333/33; 333/246

[58] Field of Search ..... 333/26, 21 R, 246, 33, 333/248

[56] References Cited

U.S. PATENT DOCUMENTS

| | | | |
|---|---|---|---|
| 3,462,713 | 8/1969 | Knerr | 333/21 R |
| 3,924,204 | 12/1975 | Fache et al. | 333/21 R |
| 4,157,516 | 6/1979 | van de Grijp | 333/246 X |
| 4,453,142 | 6/1984 | Murphy | 333/33 X |

FOREIGN PATENT DOCUMENTS

| | | | |
|---|---|---|---|
| 2421795 | 3/1977 | Fed. Rep. of Germany . | |
| 3019523 | 11/1981 | Fed. Rep. of Germany . | |
| 2229147 | 12/1974 | France . | |
| 0010656 | 1/1977 | Japan | 333/33 |
| 0055150 | 5/1979 | Japan | 333/26 |

*Primary Examiner*—Eugene R. LaRoche
*Assistant Examiner*—Benny T. Lee
*Attorney, Agent, or Firm*—Spencer & Frank

[57] ABSTRACT

A waveguide-microstrip transition arrangement including, a waveguide section and a microstrip portion, for coupling waveguide modes between the waveguide section and the microstrip portion. The waveguide section has waveguide walls defining waveguide wall surfaces including a short-circuited end wall surface and side wall surfaces. A channel passes through one of the side walls and presents an opening at the associated wall surface. The microstrip portion includes a substrate having opposite sides with a ground plane disposed on one side of the substrate and a microstrip conductor disposed on the other side of the substrate. The substrate passes through the waveguide section, entering the waveguide section at a location where the wall currents of the waveguide section flowing transversely to the substrate are at a miniumum. A portion of the microstrip conductor is disposed on the substrate to pass through the channel into the waveguide section free of contact with the waveguide walls. The substrate has no ground plane in the regions of the interior of the waveguide section and of the plane of separation of the waveguide wall where the substrate is disposed. The ground plane extends into and terminates within the channel.

3 Claims, 1 Drawing Figure

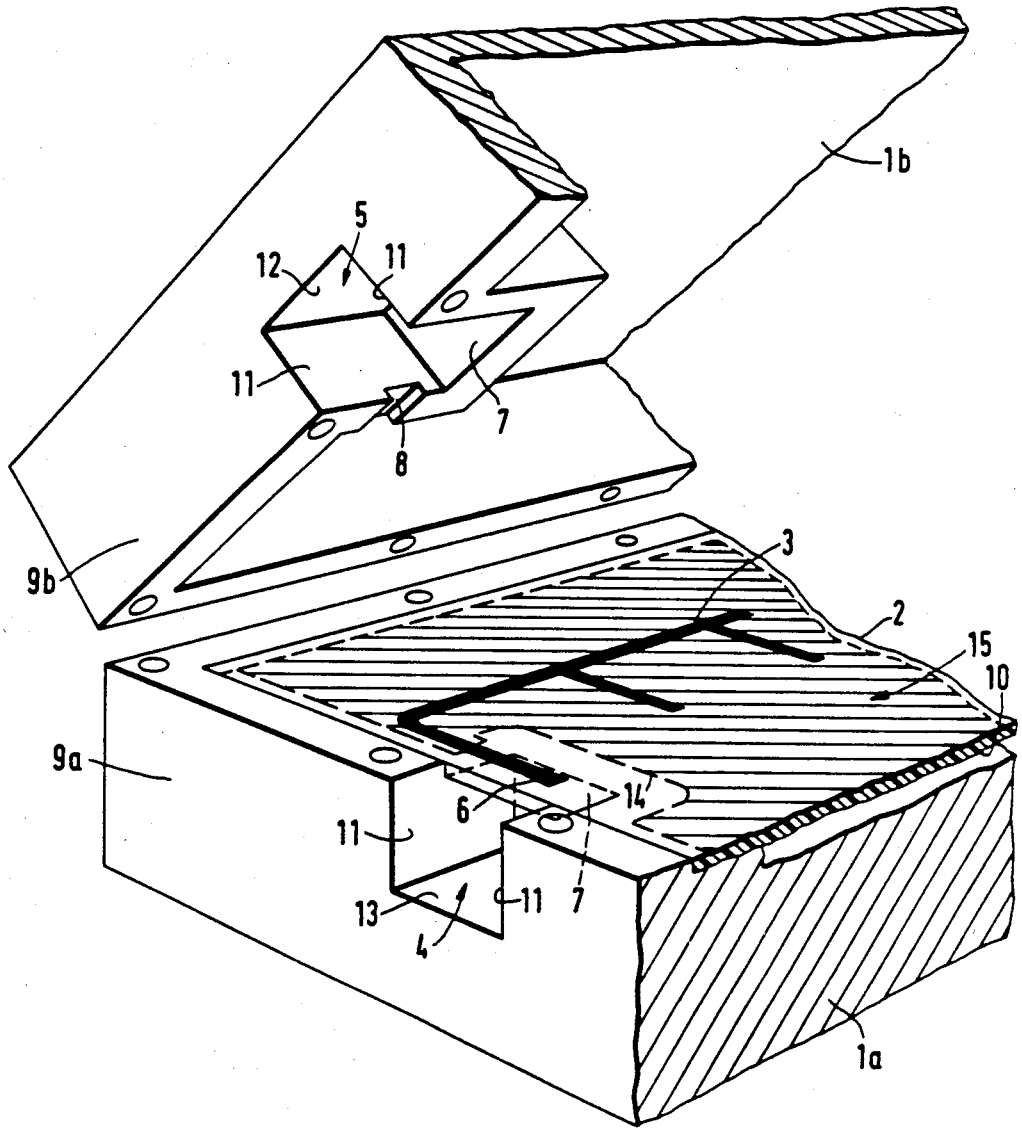
1b
5
12
11
11
7
8
9b
3
2
15
10
9a
14
6
11
13
11
7
4
1a

WAVEGUIDE-MICROSTRIP TRANSITION ARRANGEMENT

BACKGROUND OF THE INVENTION

The present invention relates to a transition arrangement between a waveguide and microstrip wherein a substrate supporting a microstrip conductor on one side and a ground plane on an opposite side penetrates into the waveguide which has a short-circuited end. A portion of the microstrip conductor carried by the substrate penetrates into the interior of the waveguide to couple in the waveguide modes. The microstrip conductor is brought into the interior of the waveguide through a channel made in the waveguide wall. A waveguide-microstrip transition of this type is described in German Pat. No. 2,421,795.

A characteristic problem in such transitions is the quality of the contact that the ground plane of the substrate carrying the microstrip conductor makes with the waveguide, because the broadband characteristics and insertion loss of the transition depend decisively upon the quality of the contact of the ground plane.

SUMMARY OF THE INVENTION

It is therefore an object of the present invention to provide a transition from a waveguide to a microstrip of the above-mentioned type in which the waveguide modes are transferred from the waveguide into the microstrip, and vice-versa, over a broad band width and with a small insertion loss without requiring the previously critical contact of the ground plane.

The above and other objects are accomplished according to the invention in which a waveguide-microstrip transition arrangement, including a waveguide section and a microstrip portion, is provided for coupling waveguide modes between the waveguide section and the microstrip portion. The waveguide section has waveguide walls defining waveguide wall surfaces including a short-circuited end wall surface and side wall surfaces. A channel passes through one of the side walls and presents an opening at the associated wall surface. The microstrip portion includes a substrate having opposite sides with a ground plane disposed on one side of the substrate and a microstrip conductor disposed on the other side of the substrate. The substrate passes through the waveguide section, entering the waveguide section at a location where the wall currents of the waveguide section flowing transversely to the substrate are at a minimum. A portion of the microstrip conductor is disposed on the substrate to pass through the channel into the waveguide section free of contact with the waveguide walls. The substrate has no ground plane in the regions of the interior of the waveguide section and of the plane of separation of the waveguide wall where the substrate is disposed. The ground plane extends into and terminates within the channel.

Thus, according to the invention the ground plane of the substrate is advantageously completely omitted in the interior of the waveguide section and in the region of the separation plane of the waveguide wall because under certain circumstances, it may have an adverse influence on the waveguide field.

BRIEF DESCRIPTION OF THE DRAWINGS

The sole FIGURE is a perspective diagram in partial cross section of an embodiment of a waveguide-microstrip transition arrangement according to the invention.

DESCRIPTION OF THE PREFERRED EMBODIMENT

The sole FIGURE shows a foldable housing composed of a lower part 1*a* and an upper part 1*b* illustrated in the folded-open position. Lower part 1*a* accomodates a microstrip 15 composed of a dielectric substrate 2 having a microstrip conductor structure 3 disposed on its upper side and a ground plane 10 shown in hatching disposed on its underside.

Lower and upper parts 1*a* and 1*b* have respective front walls 9*a* and 9*b* which are constructed to define in the folded-closed position a portion of a rectangular waveguide having inner wall surfaces including a short-circuited end wall surface 7, side wall surfaces 11, top wall surface 12, and bottom wall surface 13. The rectangular waveguide portion is divided into a lower waveguide bowl 4 being formed in a respective one of front walls 9*a* and 9*b*. The plane of separation of bowls 4 and 5 is at a point where the waveguide wall currents transverse to this plane of separation are at a minimum for the dominant $TE_{10}$-mode. But for all other waveguide modes one may find at least one plane of separation where the currents at the wall surfaces 7 and 11 transverse to the plane of separation are at a minimum. Substrate 2 is disposed to be in the plane of separation between bowls 4 and 5.

Ground plane 10 of substrate 2 is removed in the region of the waveguide interior and of the plane of separation between bowls 4 and 5, as indicated by the non-hatched area outlined by dashed line 14. Thus there is no contact between ground plane 10 of substrate 2 and any of the waveguide walls, with the exception of an extension of the ground plane into a channel 8 as discussed below. By using the waveguide-microstrip transition according to the present invention, contact of ground plane 10 with the entire housing formed by parts 1*a* and 1*b* can also be omitted.

To couple a waveguide mode to microstrip conductor 3, a microstrip conductor portion 6 of microstrip conductor 3 is provided on substrate 2 to act as a coupling probe. It enters into the waveguide at a side thereof, usually parallel to short-circuit end wall surface 7. The distance of this microstrip conductor portion 6 from short-circuit end wall surface 7 is about $(1/5)\lambda_G$ to $(\frac{1}{4})\lambda_G$, where $\lambda_G$ is the operating wavelength of the waveguide.

A channel 8 provided in upper part 1*b* opens into one side wall surface 11 of upper waveguide bowl 5 and serves as a contact free passage for microstrip conductor portion 6 into the waveguide. Preferably, plane 10 terminates on the underside of substrate 2 within channel 8. Thus, contour line 14 lies outside the walls of the waveguide except for in the region of channel 8 where contour line 14 defines the termination of ground plane 10 within the channel. Ground plane 10 in the preferred embodiment thus rests upon a portion of the waveguide wall within channel 8. When considered without substrate 2, channel 8 here represents a waveguide operated below the limit (i.e., cutoff) frequency; i.e. the broad dimension of the channel 8 is below $\frac{1}{2}\lambda_o$, with $\lambda_o$ being the free space wavelength of the highest transmitted frequency.

In a waveguide-microstrip transition used in practice according to the invention, a bandwidth of 50% and a forward attentuation of 0.1 dB were realized at an operating frequency of 13 GHz.

An example of the transition arrangement according to the invention operating in a frequency range of 10–15 GHz has a waveguide section 4,5 with a broad dimension of 19 mm and a small dimension of 9.5 mm and a channel 8 with a broad dimension of 6 mm, a small dimension of 2.5 mm and a length of 6 mm. The distance seperating the edge of ground plane 10 from wall surfaces 7 and 11 of the waveguide section is 3 mm. The material of the substrate 2 is RT-Duroid 5870 and it has a thickness of 10 mil.

It will be understood that the above description of the present invention is susceptible to various modifications, changes and adaptations, and the same are intended to be comprehended within the meaning and range of equivalents of the appended claims.

We claim:

1. In a waveguide-microstrip transition arrangement, including a waveguide section and a microstrip portion for coupling waveguide modes between the waveguide section and the microstrip portion, the waveguide section having waveguide walls defining waveguide wall surfaces including a short-circuited end wall surface and side wall surfaces with a channel passing through one of the side walls and presenting an opening at the associated wall surface and the microstrip portion including a substrate having opposite sides with a ground plane disposed on one side of the substrate and a microstrip conductor disposed on the other side of the substrate, the waveguide wall surfaces defining the interior of the waveguide section, the improvement wherein said waveguide section comprises two parts which join together at a plane of separation which passes through the walls of said waveguide section at a location where the wall currents of said waveguide section flowing transversely to said plane of separation are at a minimum, said substrate is disposed in said plane of separation, a portion of said microstrip conductor is disposed on said substrate to pass through said channel into said waveguide section free of contact with said waveguide walls, said substrate has no ground plane in the regions of the interior of said waveguide section and of the plane of separation of said waveguide walls where the substrate is disposed, except that said ground plane extends into and terminates within said channel so as to make contact with said one waveguide side wall only within the region of said channel.

2. A transition arrangement according to claim 1 and further including a housing having a front wall with a region shaped to define said waveguide section, said housing comprising two parts which join together at the plane of separation to form said waveguide section.

3. A transition arrangement according to claim 1, wherein said channel has a broad dimension which is less than one-half of the free space wavelength of the highest signal frequency transmitted by said arrangement.

* * * * *